US006883211B2

(12) United States Patent
Hoshino

(10) Patent No.: US 6,883,211 B2
(45) Date of Patent: Apr. 26, 2005

(54) CLASP AND PROCESS FOR PRODUCING THE SAME

(76) Inventor: Masahiro Hoshino, Sunny Crest Rikugien 405, 14-12, Komagome 1-chome, Toshima-ku, Tokyo 170-0003 (JP)

( * ) Notice: Subject to any disclaimer, the term of this patent is extended or adjusted under 35 U.S.C. 154(b) by 13 days.

(21) Appl. No.: 10/352,927

(22) Filed: Jan. 29, 2003

(65) Prior Publication Data

US 2003/0145442 A1 Aug. 7, 2003

(30) Foreign Application Priority Data

Feb. 1, 2002 (JP) ..... 2002-025668

(51) Int. Cl.[7] ..... A44B 17/00

(52) U.S. Cl. ..... 24/663; 24/DIG. 58; 24/DIG. 59; 24/DIG. 60

(58) Field of Search ..... 24/DIG. 53–DIG. 60, 24/663, 109, 3.6; 63/29.1, 3.1

(56) References Cited

U.S. PATENT DOCUMENTS 940,917 A * 11/1909 Asquith ..... 24/572.1
3,286,316 A * 11/1966 Marosy ..... 24/574.1
4,944,073 A * 7/1990 Haug ..... 24/594.1
5,459,909 A * 10/1995 Nussberger ..... 24/574.1

FOREIGN PATENT DOCUMENTS

JP 57-88407 5/1982
WO WO 9833411 A1 * 8/1998 ..... A44C/5/20

* cited by examiner

*Primary Examiner*—James R. Brittain
(74) *Attorney, Agent, or Firm*—Liniak, Berenato & White

(57) ABSTRACT

A clasp comprising a piston member, cylinder member, and a member for attaching and detaching said piston member to the cylinder member. The clasp of the present invention comprises an elastic member which apply a resilient force to the piston member in the direction that the piston member is separated from said cylinder member; a lock pin projected on either surface of the piston member and the cylinder member contact with each other in substantially vertical direction to the remaining surface so that projection elastic force is applied in a movable manner: a W-shaped or M-shaped guide groove including a concave portion for inserting the lock pin and having a route for directing the movement of the lock pin, which comprises a first bent portion, a second bent portion, and a third bent portion from the inlet and outlet of the route; and a member for directing the movement of the lock pin.

10 Claims, 12 Drawing Sheets

CLASP AND PROCESS FOR PRODUCING THE SAME

BACKGROUND ARTS

1. Field of the Invention

The present invention relates to a clasp used in a clasp or hook for an annular accessory such as necklace, to fastens and unclasps a string, chain, or the like, or used in a pendant or key holder with decorative portion to connects the main portions thereof, and a process for producing the same.

2. Description of Related Arts

In conventional, a clasp for necklace has been known as a faster and its production in Japanese Utility Model No. 57-88407.

Referring to FIG. 12A, which shows the conventional clasp, where FIG. 12A is a plane view, FIG. 12B is a cross-sectional view of the line A—A, and FIG. 12C is a cross-sectional view of the line B—B, a clasp 600 comprises a pair of members consisting of a male member 61 capable of being inserted into a female member 62, a communicating projection 65 (hereinafter referred to as "hereinafter referred to as "lock pin") composed of an elastomer vertically provided on the male member 61 in the direction perpendicular to the advance and retreat direction thereof, and upon locking the faster, the lock pin 65 is inserted into a concave portion 74 provided on the female member 62 and it is revolved.

Upon releasing the locked state, when the male member 61 is revolved relative to the female member 62, the lock pin 65 fellows a separating route 72 to be separated from the concave portion 74, whereby the male member 61 can be separated from the female member 62. In addition, in order to avoid unwanted, unexpected releasing of the lock, the lock pin 65 is communicated with the concave portion 72 so that the lock pin does not come out from the separating route 72 in a spontaneous manner. Specifically, the lock pin 65 cannot be separated from the concave portion 74 unless a user spins the male member 61 relative to the female member 62, while putting up the elastic force.

However, releasing the lock in the clasp 600 constructed as described above, the male member 61 must be spun relative to the female member 62 so that the lock pin 65 may follow the separating route 72 to be separated from the concave portion 74. Evan if the amount of the spinning is approximately 45°, there is a disadvantage in terms of difficult operation. Especially, in the case where the clasp is small, it is very difficult to conduct the spinning operation. Also, for the user, when the clasp is unclasped around the neck, which is difficult to be viewed, it is very difficult to conduct adequate spinning.

It is, therefore, the object of the present invention is to provide a clasp, which is difficult to be separated when the user does wants to be separated, which can easily be separated, when the user wants to be separated, and which has a simple structure so that there is no limitation in terms of design; and to provide a process for producing such a clasp in an easy manner.

SUMMARY OF THE INVENTION

The present invention provide a clasp comprising a piston member, cylinder member, and a member for attaching and detaching said piston member to said cylinder member. The clasp of the present invention comprises an elastic member which apply a resilient force to said piston member in the direction that said piston member is separated from said cylinder member; a lock pin projected on either surface of said piston member and said cylinder member contact with each other in substantially vertical direction to the remaining surface so that projection elastic force is applied in a movable manner: a W-shaped or M-shaped guide groove including a concave portion for inserting said lock pin and having a route for directing the movement of the lock pin, which comprises a first bent portion, a second bent portion, and a third bent portion from the inlet and outlet of said route; and a member for directing the movement of said lock pin.

The clasp of the present invention can be produced by a process of the present invention including the formation of said groove on a plate material, and rounding of said plate material having said groove formed thereon to provide said cylinder member or said cylinder member or said piston member.

Alternatively, the clasp of the present invention can be produced by a process of the present invention including the formation of said groove on a surface of a semi-cylindrical material for making said piston member or said cylinder member, combining said semi-cylindrical material with another semi-cylindrical material to provide said piston member or said cylinder member.

BRIEF DESCRIPTION OF THE DRAWINGS

FIG. 6 is a side view of a clasp 100*c* according to one embodiment of the present invention in which the outer circumference of the cylinder member 10*c* is fit to and covered with a glass bead 17, where

DESCRIPTION OF PREFERRED EMBODIMENTS

Figure 1A:
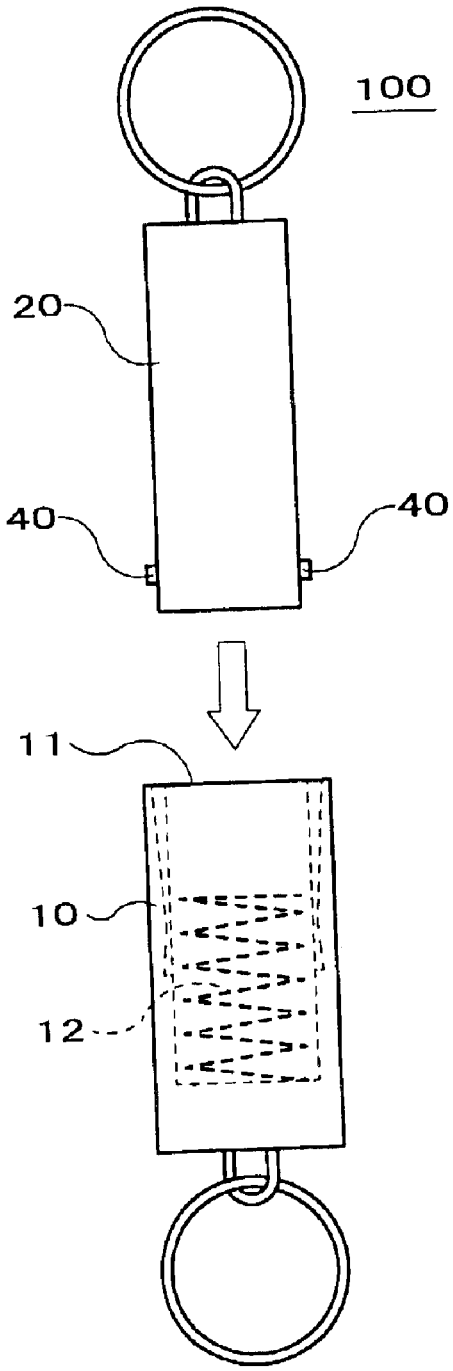
FIG. 1A is aside view of the clasp according to the present invention.

Embodiments of the present invention will now be described. First, embodiments where the clasp of the present invention is applied to a clasp for a necklace will be described by referring to the drawings.

Figure 1B:
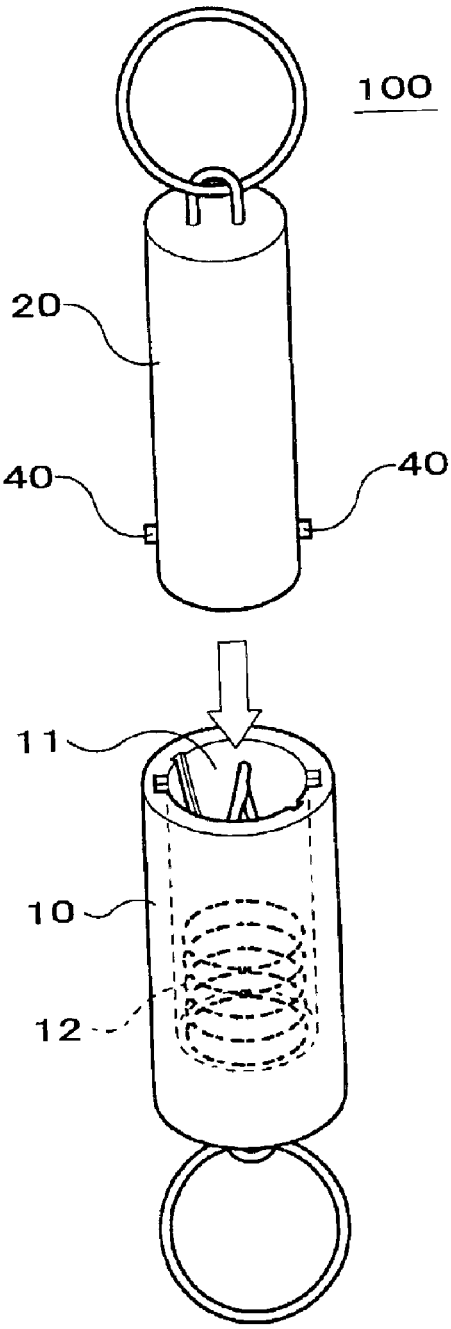
FIG. 1B is a perspective view of clasp according to the present invention.

Referring to FIG. 1, the clasp 100 of the present invention mainly comprises a pair of members, i.e., a cylinder member 10 and a piston member 20. Each end of the cylinder member 10 and the piston member 20 is configured to be connected with a string etc. making up a necklace.

In order to insert the piston member 20 from an inlet 11 of the cylinder member 10 in the direction shown as an arrow in FIG. 1 and to fasten and open the clasp 100, lock pins 40 and 40 as a lock mechanism which will be described later on, are projected on the outer circumference of the piston 20 at the portion near the edge in a manner that they are movable through their elastic forces. The locks 40 and 40 have a cylindrical force, and if the edges thereof have a hemispheric shape, they can smoothly move. In this case, however, such a shape will causes the unwanted leasing of the lock. In a preferred embodiment of the present invention, the edge of lock pin is appropriately rounded off the corners, although not shown in the drawings.

Hereinafter, the configuration of the parts will be described in detail together with the insertion of the clasp 100, the attaching and detaching the lock pin.

Figure 7:
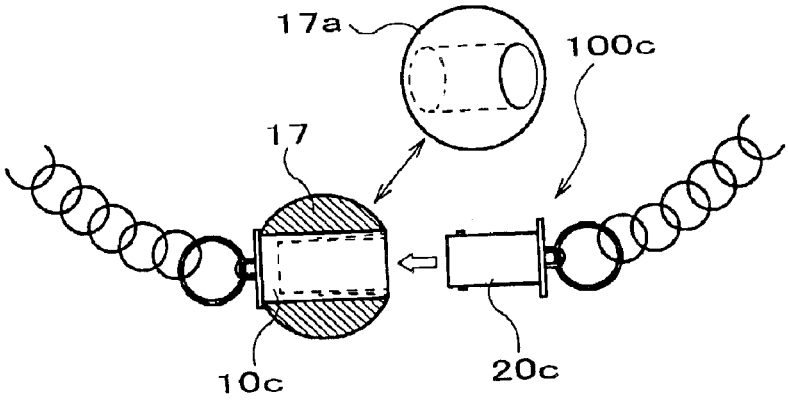
FIG. 7 is a drawing showing an embodiment where the clasp 100*c* with an exchangeable glass bead 17, 17*a* is used as a clasp for a necklace.
Figure 10:
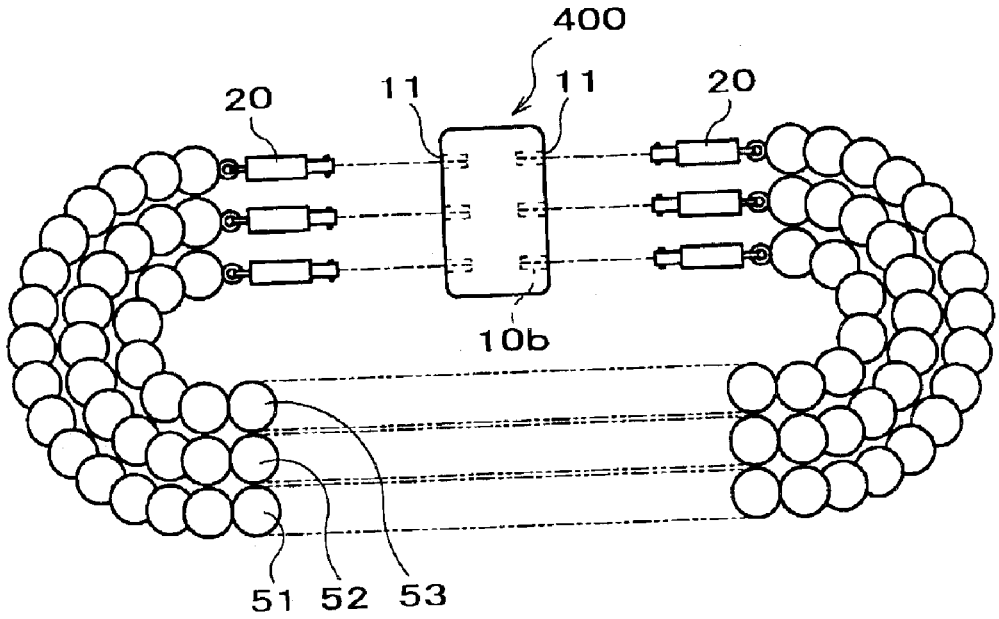
FIG. 10 is a front view of a necklace in which the clasp 100 of the present invention is applied to multiple strand clasps 400.

When the user will hang a necklace around the user's neck (not shown), first the cylinder member 10 and the piston member 20 of the clasp 100 are separated from each other so that ring composed of the string, one end of which is connected to the edge of the cylinder member 10 and the other to the edge of piston member 20, is opened (also see FIG. 7 and FIG. 10).

Second, the user places the necklace on the neck and then connects the clasp 100 to close the ring.

By means of a coil spring 12 making up the lock mechanism, an elastic force for detaching the piston member 20 from the cylinder member 10 is applied in the direction of detaching the piston member 20 from the cylinder member 10 to direct the lock pin to the lock state and to maintain the locked state.

Figure 2:
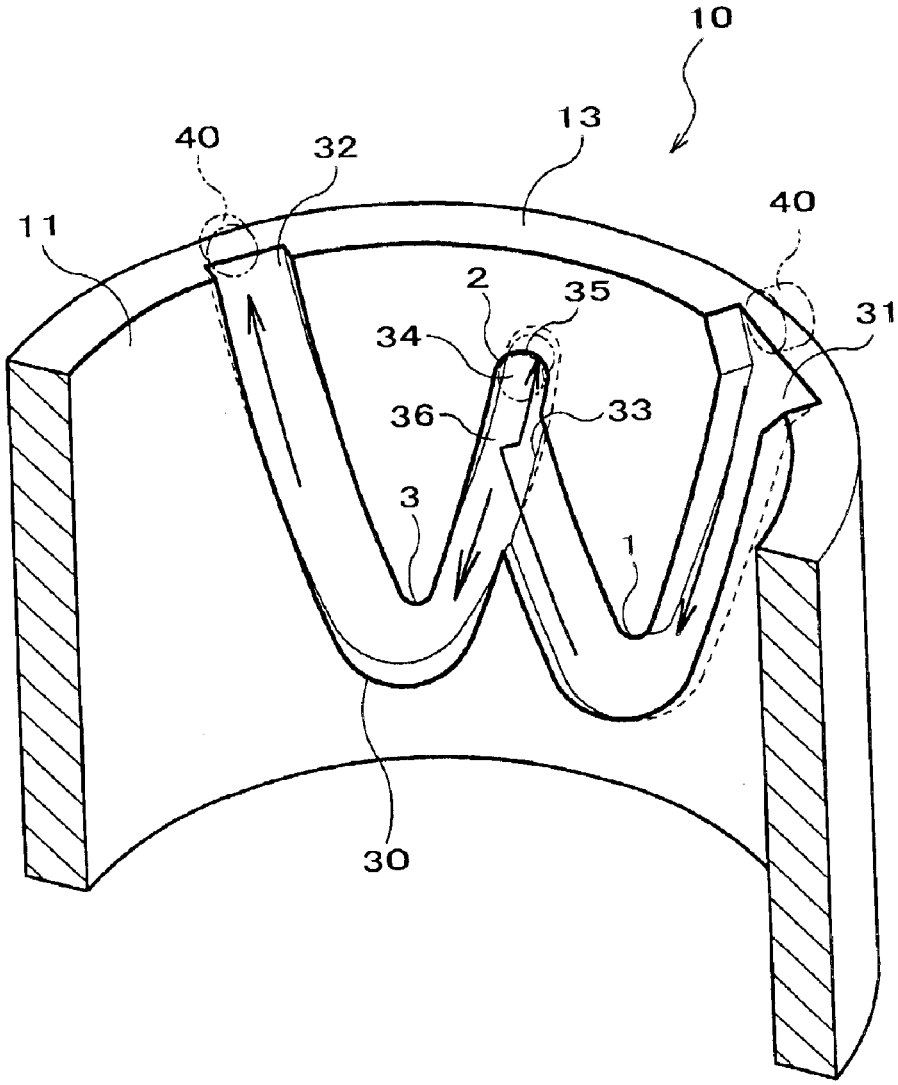
FIG. 2 is an enlarged perspective partially cutaway view of the main portion of the cylinder member according to the present invention.

Referring to FIG. 2 and FIG. 3, the situation of the lock pin 40 sliding along a W-shaped guide groove 30 will be described.

Figure 3A:
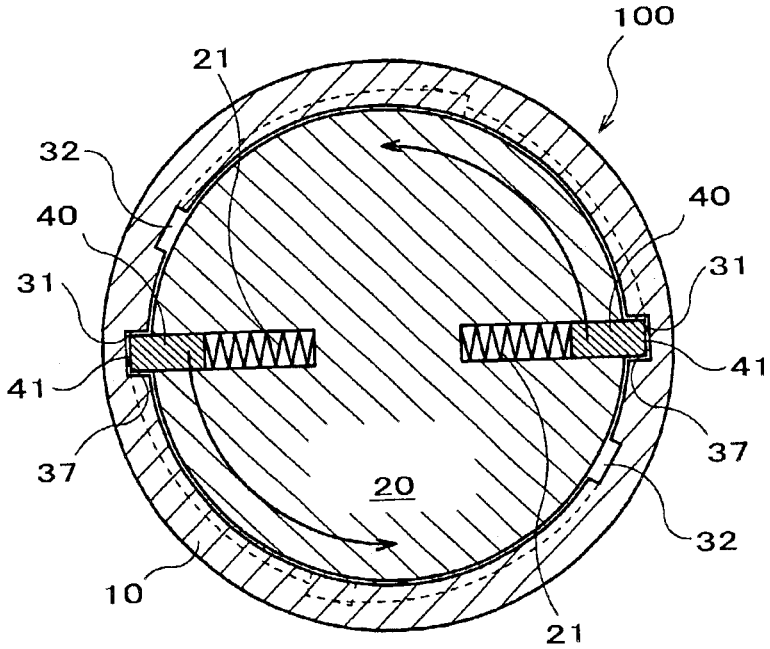
FIG. 3A is a cross-sectional view of the clasp of the present invention in the connected state near the center of the lock pin.

As shown in FIG. 2, the guide groove 30 is provided on an inner circumference of the cylinder member 10 in such a manner that an inlet 31 and an outlet 32 of the guide groove 30 are opened towards an inlet 11 for insertion. The guide groove 30 is also configured so that the lock pin 40 can be moved in the determined direction shown as the arrow in FIG. 2 through a first bent portion 1, a second bent portion 2, and a third bent portion 3. With regard to the depth of the inlet 31 of the guide groove and that of the outlet 32 having a relation described later on, the dept of the inlet 31 is deep and the depth of the outlet 32 is shallow. Consequently, even if the lock pin 40 is inserted from the outlet 32 by mistake, due to the restriction of the size of a tip 41, the insertion of the lock pin 40 is prevented as can be seen in FIG. 3A. Upon locking the clasp 100, the user does not insert the lock pin 40 from the outlet 32 by mistake.

Upon locking the clasp 100, the piston member 20 is inserted into the cylinder member 10. At this time, the lock pin 40 is communicated with the inlet 31, and the lock pin 40 is inserted until it comes into contact with the top of the outer circumference 39. If the force to pushing the lock pin 40 in is relaxed, by the elastic function of the coil spring, which will be separated, the lock pin 40 is slid along the guide groove 30 from the first bent portion 1 to the second bent portion 2.

When the lock pin 40 moves from the inlet side to the outlet side and passed through a step 33, the lock pin 40 falls into a hole 34 for receiving the lock pin placed in front of a projection 35 of the second bent portion 2 at which the clasp 100 is locked by the action of the projection elastic force of the lock pin 40.

Adjacent to the hole 34 for receiving the lock pin 40, an outer circumference of the second bent portion 2 has the projection 35 which can receive the lock pin 40 and hold it. A side surface of the lock pin 40 is brought into contact with the projection 35 due to the function of an elastic force of the coil spring 12, which will be separated, so that the locked-state is maintained. What is more, the hole 34 for receiving the lock pin resides at the deepest position of the guide groove 30, which is a concave portion into which the edge 41 of the pin 40 is inserted and is stabilized.

Considering the function of the elastic force for the projection as the gravity, the hole 34 for receiving the lock pin is not a through hole perforated into the direction of the gravity but a concave portion into which the lock pin 40 projected in an elastic manner is inserted and stabilized. The direction of the concave portion depends on the spatial position of the clasp 100, and has a not relation to the gravity.

As shown in FIG. 3A, lock pins 40 and 40 are substantially radially extending from the outer circumference of the piston member 20, and an elastic force is applied to the lock pins 40 and 40 to be freely movable.

The shape of the coil spring 21 is not specifically restricted, and, for example, the spring in the form of a Belleville spring may be used (not shown).

Figure 3B:
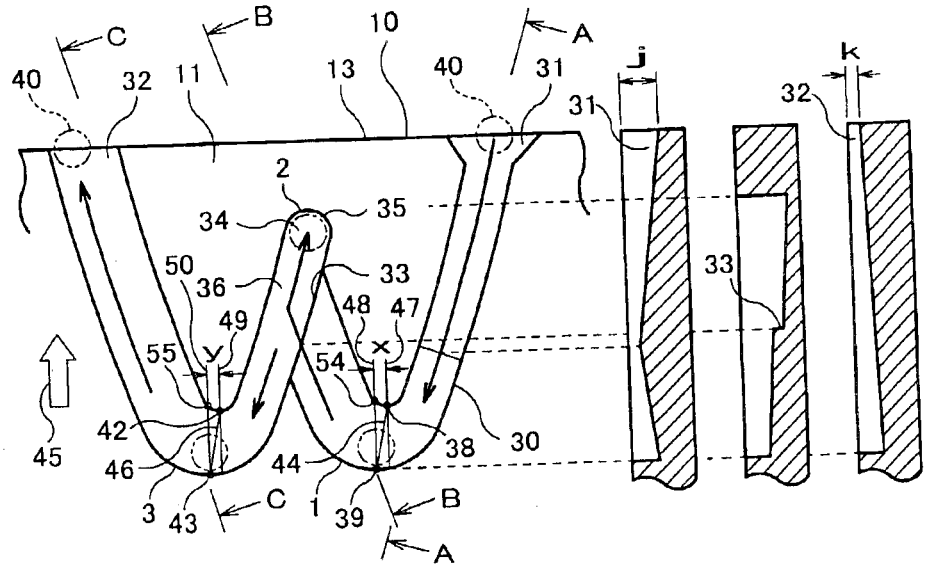
FIG. 3B is a development where the inner surface of the cylinder member shown in FIG. 3A is developed into a plate surface.

A part of the edge 13 of the insert hole 11 has a cutaway portion, and the cutaway portion is configured to form the inlet 31 and the outlet 32 of the guide groove 30. As shown in FIG. 3B (A—A cross-sectional view), the inlet 31 has a depth d of the groove, and as shown in FIG. 3B (C—C cross-sectional view), the outlet 32 has the depth k of the groove. Since the depth k is smaller than the depth j, even if the lock pin 40 will be inserted from the outlet 32 by mistake, the insertion of the lock pin 40 is prevented by the size restriction as can be understood from FIG. 3A. Consequently, there is no case where when the user locks the clasp 100, the lock pin 40 is inserted from the outlet 32 by mistake.

The operation of the lock pin 40 will be described in more detail through the first bent portion 1, the second bent portion 2 and the third bent portion 3 shown in FIG. 3B as an arrow.

First, the line 44 connecting the top 38 of the inner circumference of the first bent portion 1 to the top 39 of the outer circumference thereof is slanted relative to the direction 45 where the piston 20 is separated, and the direction of the slanting is configured so that the top 38 of the inner circumference of the first bent portion 1 is nearer the inlet 31 than the top 39 of the outer circumference. Specifically, when lines 47, 48 parallel to the direction 45 disappear, the line 47 including the top 38 of the inner circumference is a distance x nearer to the inlet 31 than the line 48 including the top 39 of the outer circumference. Consequently, after the piston member 20 is pushed into the cylinder member 10 by the user, the lock pin 40 comes into contact with the top 39 of the outer circumference. Then the user relaxes the pushing, and the lock pin 40 is pushed by the elastic force of the coil spring for the separation (See FIG. 1), then comes into contact with a point 54 far from the inlet 31 beyond the top 38 of the inner circumference. For this reason, the lock pin 40 is in the state where it is difficult to return back. Furthermore, if the lock pin 40 is pushed in the direction 45, while it is regulated by the guide groove 30, the lock pin 40 moves towards the hole 34 for receiving the lock pin in a smooth manner.

Next, the guide groove 30 has a step 33 so that the guide groove 30 is shallow on the side of the inlet 31 while deep on the side of the outlet 32, and an escape slope 36 for escaping the lock pin 40 from the hole 34 and for receiving the lock pin in a smooth manner formed thereon.

Due to the steps 33, even if the user will separate the piston member 20 from the cylinder member 10, they cannot be separated since the lock pin 40 is locked at the second bent portion 2. When the piston member 20 is pushed again, since the lock pin 40 cannot slip from the steps 33, it is separated from the escape slope 36 through the steps 33 and the escape slope 36 without retraction. As described above, the lock pin 40 is inserted into the hole 34 to be locked and when the lock pin 40 is separated from the escape slope 36, the lock is released.

A line 46 connecting the top 42 of the inner circumference of the third bent portion to the top 43 of the outer circumference is slanted relative to the direction 45 where the piston member 20 is separated. The slanting direction is formed so that the top 42 of the inner circumference is nearer the inlet 31 than the top 43 of the outer circumference. Specifically, when lines 49, 50 parallel to the direction 45 where the piston 20 is separated are consumed, the line 49 including the top 42 of the inner circumference is y nearer the inlet 31 than the line 50 including the top 43 of the outer circumference. Consequently, after the piston member 20 is pushed into the cylinder member 10 by the user, the lock pin 40 is come into contact with the top 43 of the outer circumference, and then the user relaxes the pushing, the lock pin 40 is pushed by the coil spring through the elastic force for the separation (See FIG. 1) in the direction 45, and then is come into contact with a point 55 far from the inlet 31 beyond the top 42 of the inner circumference. For this reason, the lock pin 40 is in the state where it is difficult to return back. Furthermore, if the lock pin 40 is pushed in the direction 45, while it is regulated by the guide groove 30, the lock pin 40 moves towards the hole 34 for receiving the lock pin in a smooth manner.

As described above, since the slope 36, which allows the lock pin 40 the smoothly moving while sliding the lock pin 40 along the guide groove 30 as the cum movement, is provided, the releasing of the lock can be made without any hold.

Figure 4:
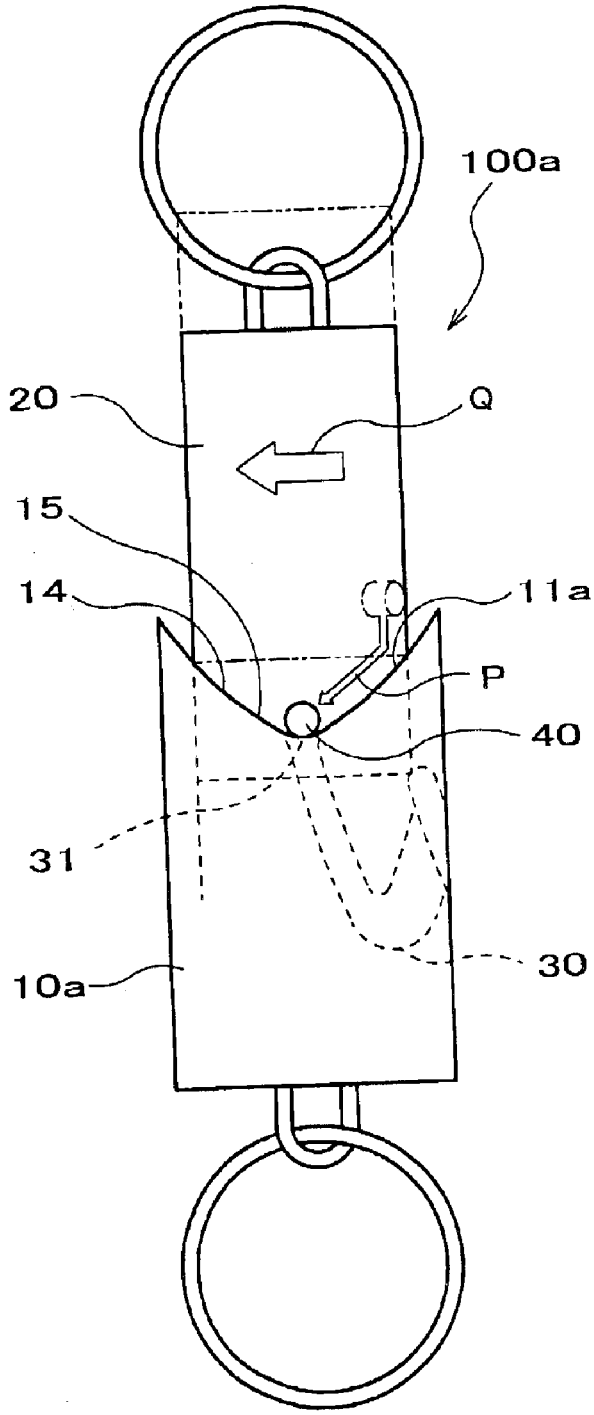
FIG. 4 is a side view of a clasp 100*a* according to one embodiment of the present invention in which a guide taper 14 is provided on an inlet 11*a* of the cylinder member 10*a*.

Referring to FIG. 4, which is a side view of a clasp 100*a* according to one embodiment of the present invention in which a guide taper 14 is provided, a guide taper 14 has a V-shaped cutaway viewing from the side in such a manner that the opening of the insert hole 11*a* of the cylinder member 10*a* is wide and the inner part thereof is narrow. When the piston member 20 is inserted, the V-shaped cutaway 15 guides the lock pin to the most inner part of the guide taper 14, corresponding to and connecting to the inlet 31 of the guide groove 30.

Specifically, the piston member 20 is inserted into the insert hole 11*a* of the cylinder member 10*a* and come into contact with any portion of the guide taper 14, after which guide taper 14 acts as the cum surface relative to the lock pin 20 when the piston member 20 is deeply inserted. The lock pin 40 moves toward the direction shown as arrow P on the guide taper 14 (cum surface) and arrives at the inlet 31. The lock pin 40 is, projected on the outer circumference of the piston member 20 and it cannot move in the circumferential direction thereof. Accordingly, when the lock pin 40 moves in the direction shown as the arrow P, the piston member 20 is spun in the direction shown as arrow Q together with the movement of the lock pin 40. The lock pin 40 arrives at the inlet 31 while defining the spinning angle of the piston member 20 relative to the cylinder member 10*a*.

It is noted that the V-shaped cutaway 15 include any curve shape in which the insert portion is wide and the most inner part is narrow to be guided to the inlet 31, such as U-shaped cutaway.

The operation of clasp according to the present invention will be explained. When the user puts a necklace utilizing claps 100 and 100*a* on the neck, in order to separated the cylinder members 10 and 10*a* and the piston members 20 from each other, the lock is released: the piston members 20 are pushed towards the inner parts of the cylinder members 10 and 10*a* to allow the lock pin 40 for arriving at the third bent portion 3 (See FIG. 2 and FIG. 3), and then the pushing force is relaxed whereby the lock is released by the elastic force for separation. This opens clasps 100 and 100*a* to be ready for wearing the necklace (Also, see FIG. 7 and FIG. 10).

Subsequently, the necklace is hung on the neck and the ring is closed to lock the clasps 100 and 100*a*. Specifically, the user inserts the piston member 20 into the cylinder member 10 and pushes to allow the lock pin 40 for arriving at the first bent portion 1 (See FIG. 2 and FIG. 3), and the relaxes the pushing force. Since this operation is very easy so that the user may be carried out even in the case of not showing the state.

What is more, the locked claps 100 and 100*a* cannot be opened spontaneously unless the user carries out the unlocked operation.

In the case where the user takes off the necklace, the user pushes the piston member 20 to the inner portion of the cylinder member 10 (10*a*) to allows the lock pin 40 for arriving at the third bent portion 3 (See FIG. 2 and FIG. 3), and then the pushing force is relaxed, whereby the piston member 20 is separated from the cylinder member 10 (10*a*) by the elastic force for the separation. At this time, the connection of the clasps 100 and 100*a* is opened to open the ring of the necklace (Also, see FIG. 7 and FIG. 10) to be ready for taking off the necklace.

As described above, the user does not need to perform the spinning operation at the time of taking off the necklace, and thus, the operation is very easy. Instead of the user, the spinning of the piston member according to the the present invention is carried out by cam function of the lock pin 40 guided by the guide groove 30.

Consequently, the connection and the separation of the clasp of the present invention can be carried out in an easier manner that those of the conventional clasp.

Next, the process for producing the cylinder member 20 will be described.

According to the usual process for producing the machine, caving processing of an inner circumference of a tube or cylinder is restricted to the process which can form a simple inner surface. However, the cylinder member 10 according to the present invention has a small outer size and an inner surface having a complicated guide groove formed thereon, and thus, it is difficult to produce it by the conventional processing.

According to the present invention, a press processing is applied to a plate material such as made of a metal to form the guide groove 30 on the surface of the plate material before the formation of the tubular cylinder material 10, and the plate material with the guide grove formed thereon is rounded to form a tube. The use of press processing can form a complicated M-shaped or W-shaped guide groove 30 by one press. The rounding of the plate material can be carried out the process well known in the art.

In the embodiment of the present invention as shown in FIG. 3A, a set of lock pins 40 comprising two lock pins are provided on the circumference rounding the piston member 20 at a relative position of 180°, and the two W-shaped guide grooves 30 are proved on the inner circumference of the cylinder member 10 at the same relative position. The number of the lock pins and the number of the guide grooves should not be restricted, they may be at least one.

Figure 13:
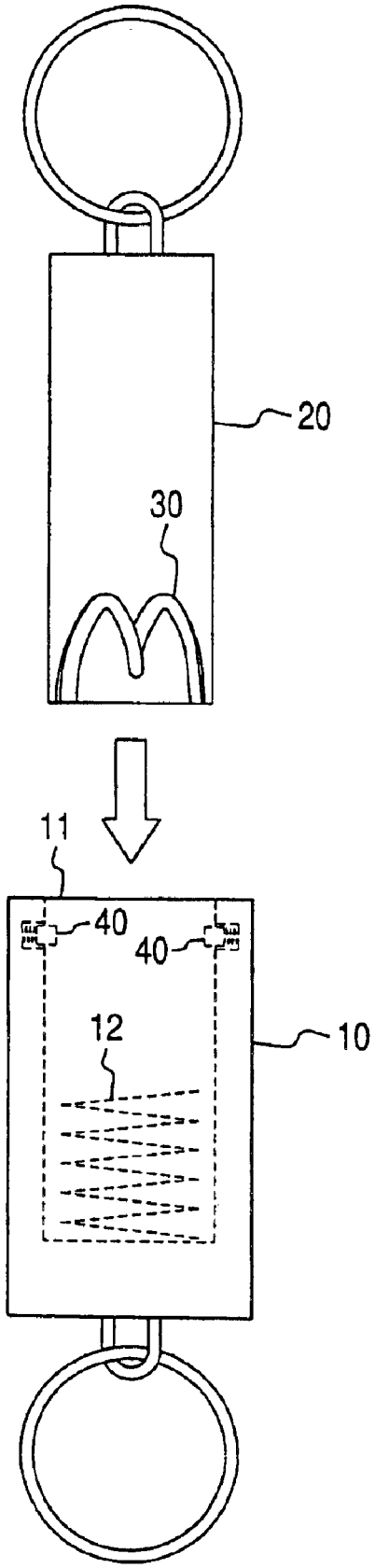
FIG. 13 is a side view of the clasp according to the alternative embodiment of the present invention.
Figure 14:
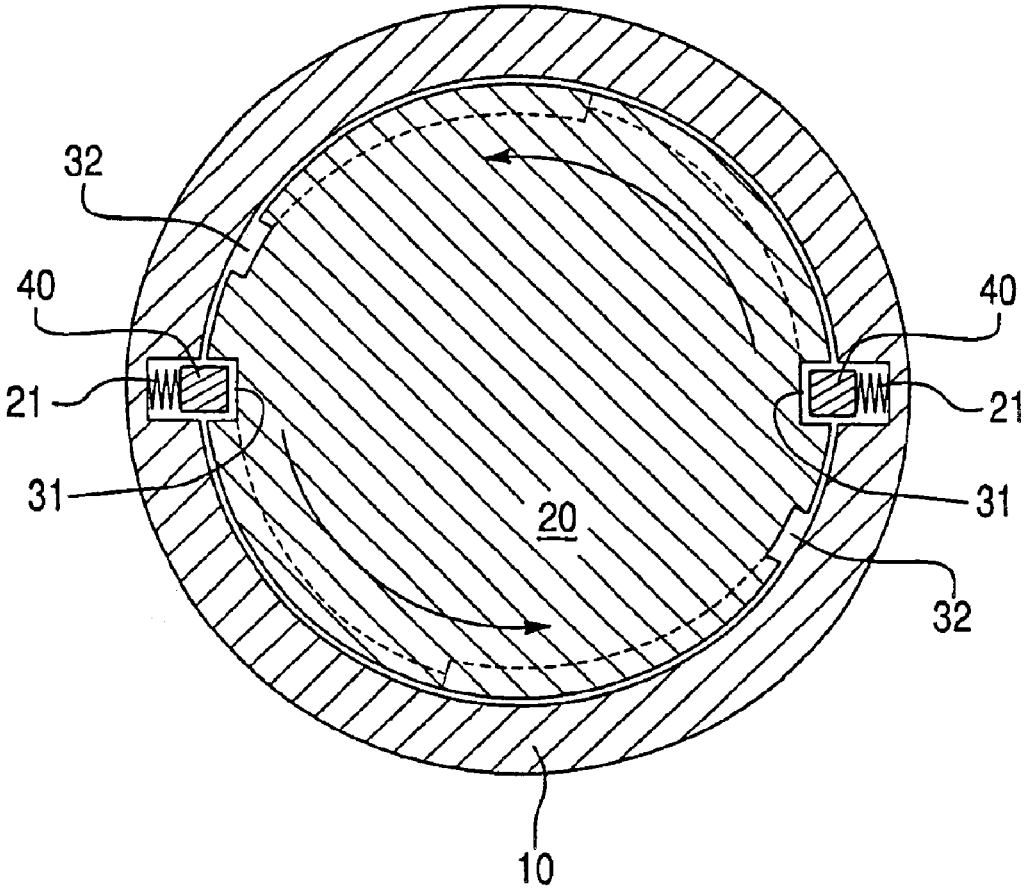
FIG. 14 is a cross-sectional view of the clasp in the connected state near the center of the lock pin according to the alternative embodiment of the present invention.

The guide groove 30 may be provided on the inner surface of the cylinder member 10 as shown in FIG. 2 or may be provided on the outer surface of the piston member 20 as shown in FIG. 13. In the latter case, the lock pin 40 should be provided on the inner surface of the cylinder member 10 as shown in FIG. 14.

Figure 5:
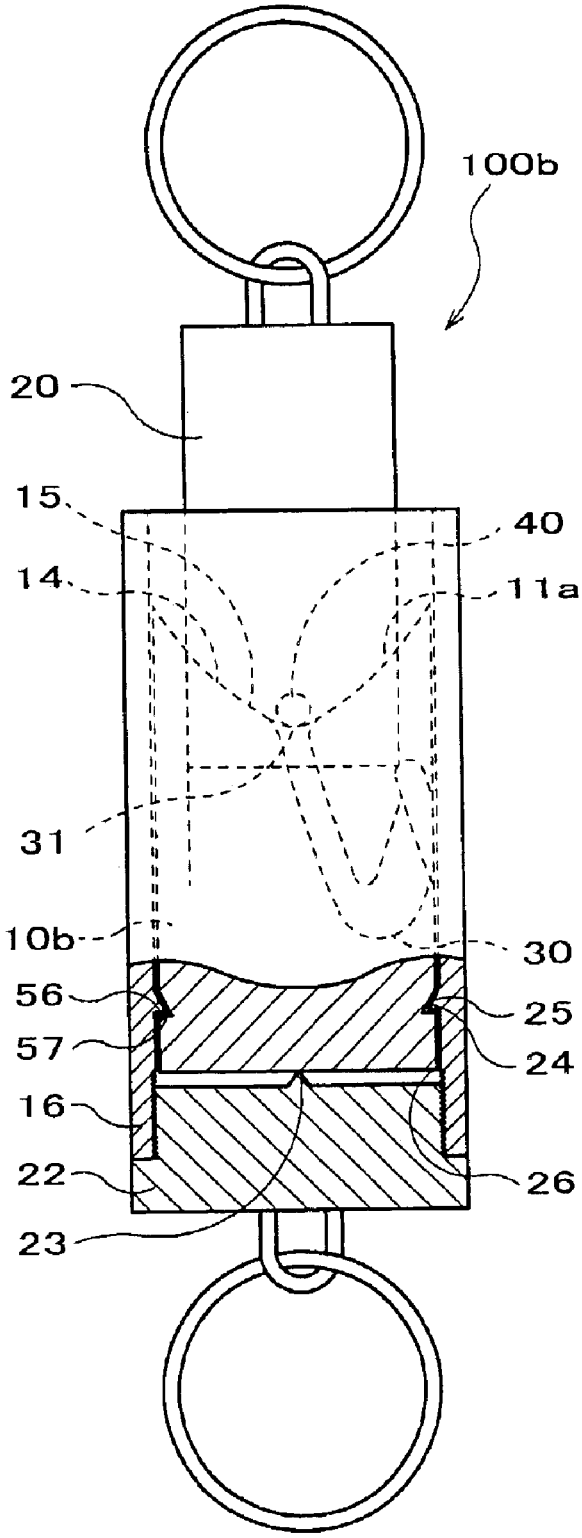
FIG. 5 is a side view of a clasp 100*b* according to another embodiment of the present invention in which the outer circumference of the cylinder member 10*b* is covered to provide a rotatable cover 16.

Referring to FIG. 5, which is a side view of a clasp 100*b* according to another embodiment of the present invention in which the outer circumference of the cylinder member 10*b* is covered to provide a rotatable cover 16, one end of the rotatable cover 16 is covered with a disc type screw cap 22. At the inner side, the center of the screw cap 22 has a cone shape to form a pivot to support the center portion of the cylinder member 10*b* which is a flat surface with a little friction. A groove 24 tightened in the middle is provided on an outer circumference of the cylinder member 10*b* near the bottom surface of the cylinder member 10*b* so as to be rounded around the outer circumference. A projection 25 in a saw shape is provided on an inner surface of the cover 16 so as to surround the groove 24 from the outside and to be inserted in a loose manner. Since the projection 25 can be slid in the groove direction of the groove 24, the cylinder member 10*b* is supported by the cover 16 in a rotatable manner.

The projection 25 may be formed by machining, press forming or any other processing method. The projection 25 is formed to be somewhat elastic. In order to assemble the clasp 100*b*, when the cylinder member 10 is inserted into the cover 16, the edge portion 26 of the cylinder member 10*b* is pushed in against the elastic force of the projection 25. When the edge portion 26 forcedly moves along the slope of the projection 25 and arrives at the innermost portion of the cover 16, the shape of the projection 25 is returned due to its elastic force and, as shown in FIG. 5, it is inserted into the groove 24. Then, the vertical surface 56 of the projection 25 is come into contact with the vertical surface 57 of the groove 24 to hold the cylinder member 10*b* so as not to escape it from the cover 16.

As described above, the clasp 100*b* which has a simple configuration and which can easily be produced has a cylinder member 10*b* inserted into the cover 16, which can be freely spun can be used with no user's sense of spinning when it is locked or unlocked.

Figure 6A:
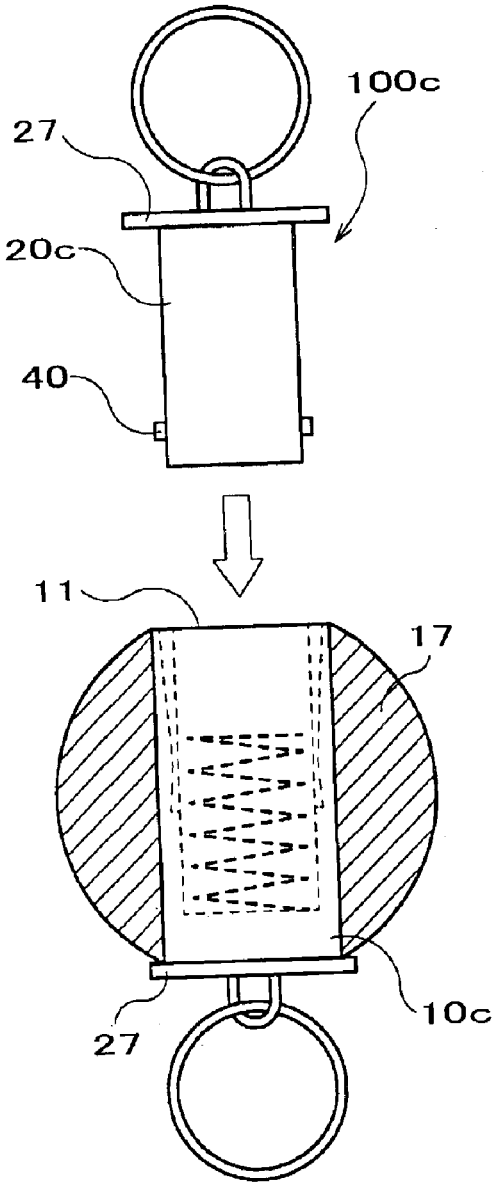
FIG. 6A is a front view of the clasp before the connection.
Figure 6B:
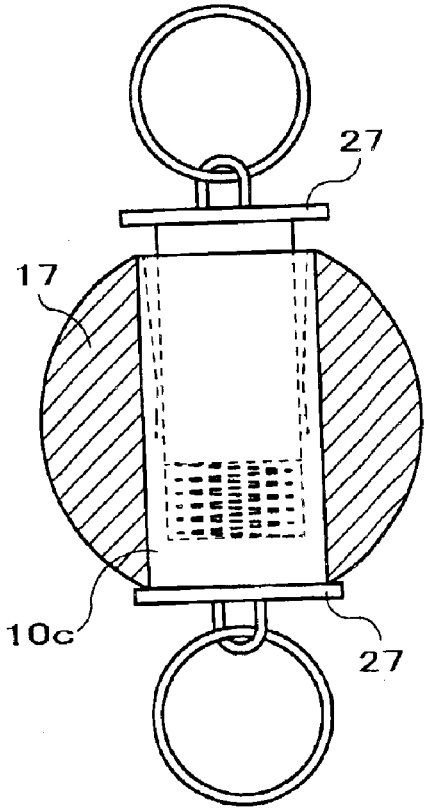
FIG. 6B is a front view of the clasp after the connection.

FIG. 6 is a side view of a clasp 100*c* according to one embodiment of the present invention in which the outer circumference of the cylinder member 10*c* is fit to and covered with a glass bead 17, where FIG. 6A is a front view of the clasp before the connection, and FIG. 6B is a front view of the clasp after the connection. Glass bead may be any of the beads known in the art, may be colored or colorless, or opaque, and may be made of a natural or synthesized material.

The basic operation for locking or unlocking the clasp 100*c* is omitted because they resemble those of the clasps 100*a*, 100*b* shown in FIGS. 1 to 4.

The class bead 17 has through hole at the center thereof with a precision and a size enough to closely accommodate the outer circumference of the cylinder member 10*c*. The cylinder 10*c* may be fixed or provided in a detachable manner. This is accomplished by determining the size and the precision.

A flange is provided at each end of piston member 20*c* and the cylinder member 10*c* so that the glass bead 17 can easily be fixed.

FIG. 7 is a drawing showing an embodiment where the clasp 100*c* with an exchangeable glass bead 17, and 17*a* is used as a clasp for a necklace. When the glass beads can be detached and be exchanged by another one, the glass bead can be replaced depending upon the preference of the user and, thus, the glass bead having a different color and/or different shape can be used. This prevents the users from loosing interest, which then enlarge the service life of the goods. If is, of course, possible to configure that no glass bead is provided.

The glass bead 17 according to the embodiment shown in FIG. 6 is only by the way of exemplification, and any shape of the glass bead other than globe may be used as long as it is harmless and safety.

Figure 8:
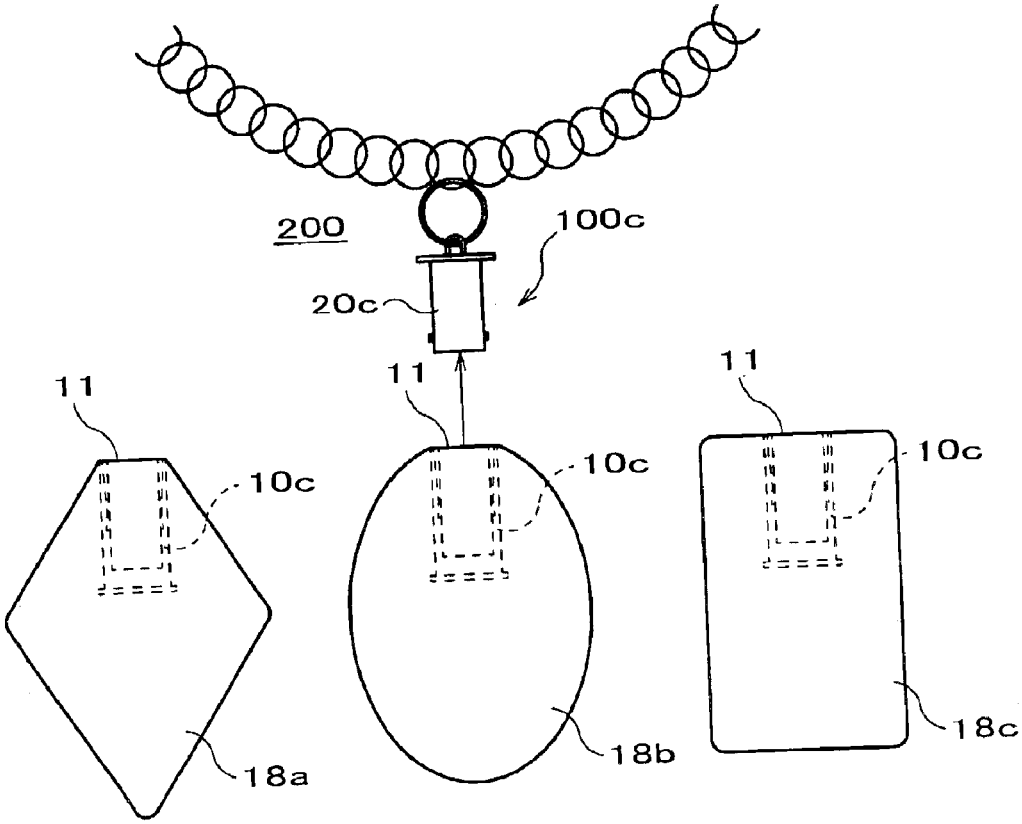
FIG. 8 is a drawing showing another embodiment where the clasp 100*c* shown in FIG. 6 comprising an exchangeable decorative part 18*a*, 18*b*, 18*c* into which the cylinder member 10*c* is embedded is used as a clasp for a plug-in type pendant 200.

FIG. 8 is a drawing showing another embodiment where the clasp 100*c* shown in FIG. 6 comprising an exchangeable decorative part 18*a*, 18*b*, 18*c* into which the cylinder member 10*c* is embedded is used as a clasp for a plug-in type pendant 200. With regard to the exchangeable decorative part 18*a*, 18*b*, or 18*c*, by inserting the piston member 20*c* into the innermost part of the cylinder member 10*c* from the insert hole 11 and relaxing the pushing force the clasp 100*c* is locked, and by pushing the piston member into the innermost part of the cylinder member 10*c* again and relaxing the pushing force, the clasp 100*c* is opened, whereby the exchangeable decorative part 18*a*, 18*b*, or 18*c* can be exchanged. In this case, there are advantages that it is difficult to loose the interest and thus, the service life can be prolonged. The exchangeable decorative part 18*a*, 18*b*, or 18*c* may have any shape, which can fit the cylinder member 10*c* and may be made of any material, which is harmless and safety.

Figure 9:
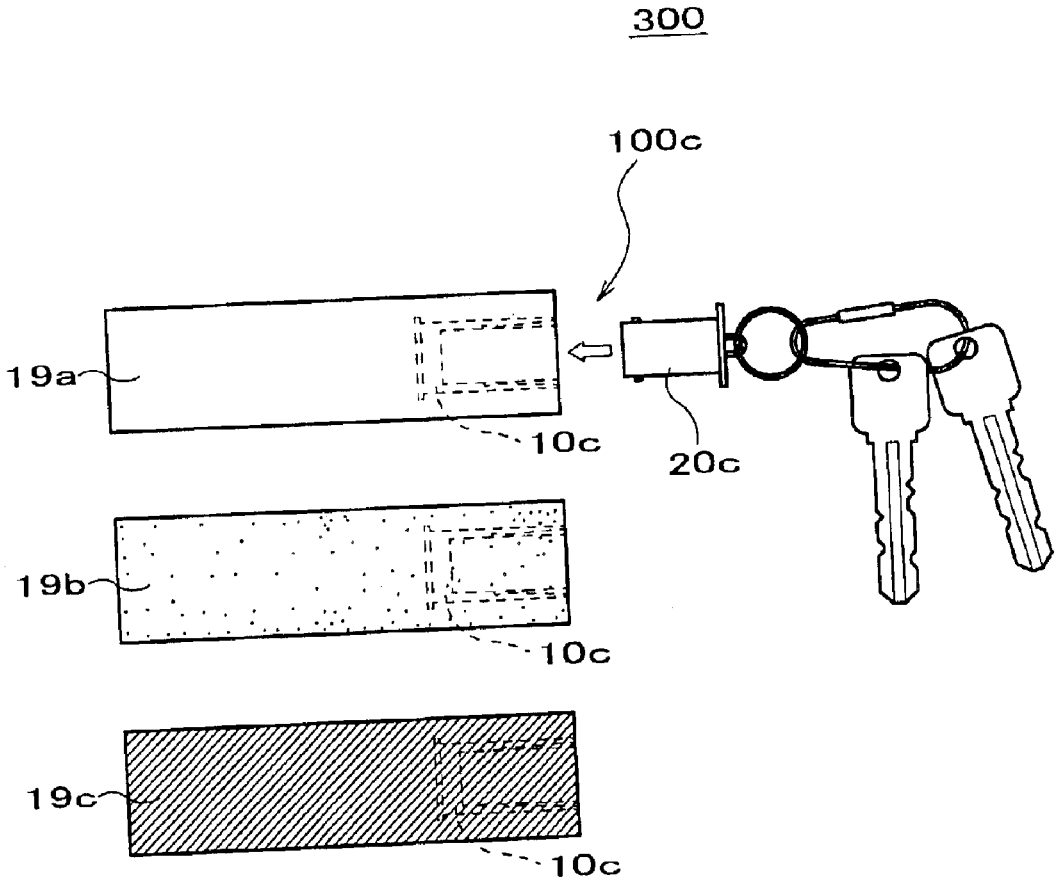
FIG. 9 is a drawing showing still another embodiment where the clasp 100*c* shown in FIG. 6 comprising an exchangeable decorative part 18*a*, 18*b*, 18*c* into which the cylinder member 10*c* is embedded is used as a clasp for a plug-in type key holder 300.

FIG. 9 is a drawing showing still another embodiment where the clasp 100*c* shown in FIG. 6 comprising an exchangeable decorative part 18*a*, 18*b*, 18*c* into which the cylinder member 10*c* is embedded is used as a clasp for a plug-in type key holder 300. The detailed description, which is as described in the column of the FIG. 8 showing the plug-in type pendant, will be omitted.

Figure 11:
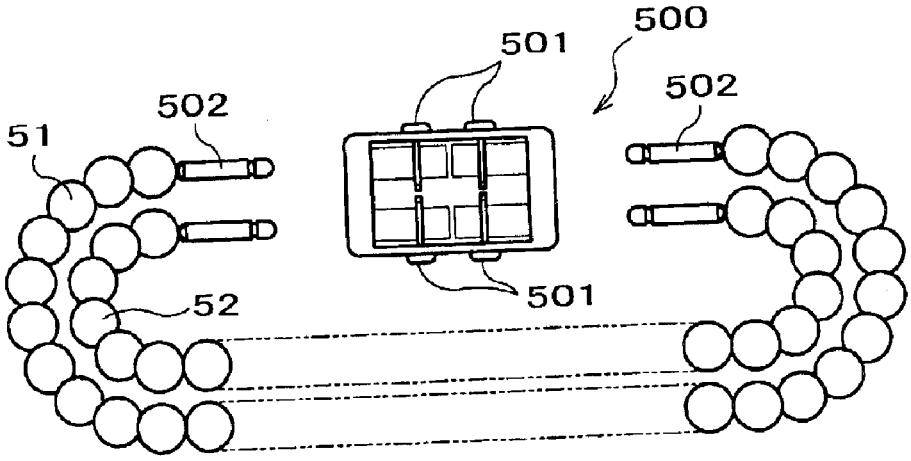
FIG.11 PRIOR ART
FIG. 11 is a front view of a necklace in which the conventional push-button type clasp 100 is applied to multiple strand clasps 500.
Figure 12A:
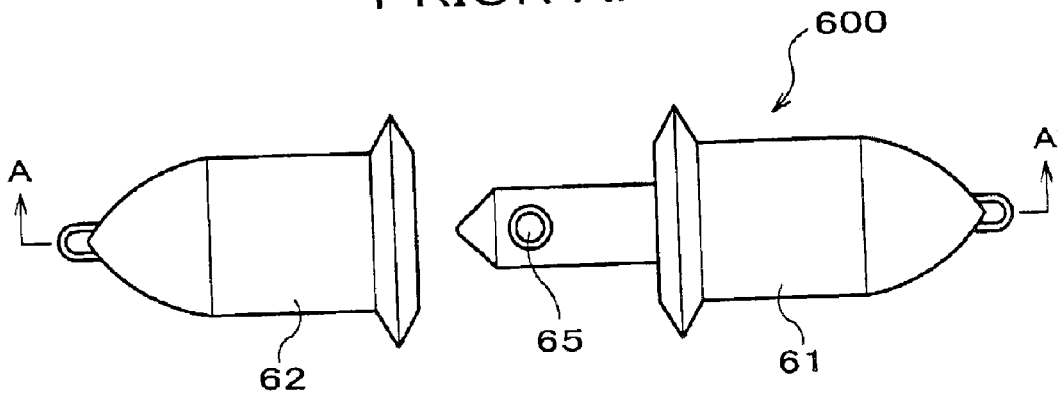
FIG.12A PRIOR ART
FIG. 12A shows a front view of the conventional clasp.
Figure 12B:
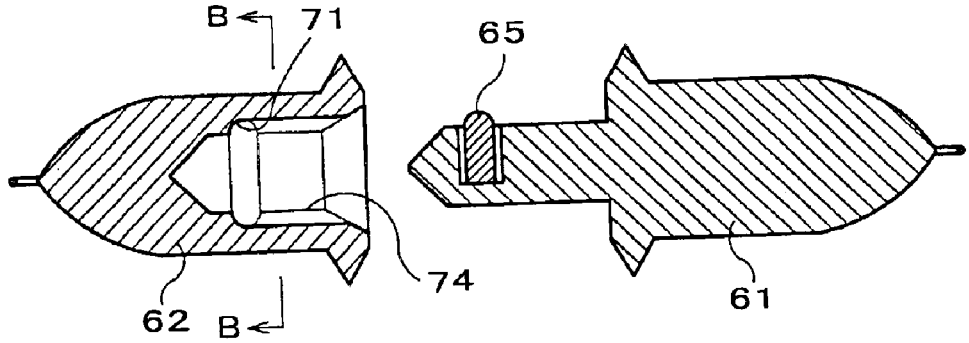
FIG.12B PRIOR ART
FIG. 12B is a cross-sectional view taken along with the line A—A.
Figure 12C:
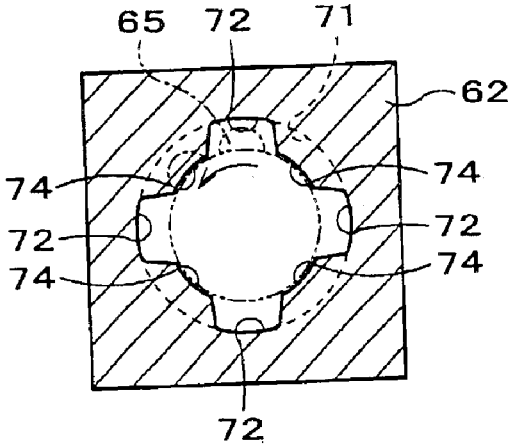
FIG.12 C PRIOR ART
FIG. 12C is a cross-sectional view taken along with the line B—B.

FIG. 10 is a front view of a necklace in which the clasp 100 of the present invention is applied to multiple strand clasps 400, and FIG. 11 is a front view of a necklace in which the conventional push-button type clasp 100 is applied to multiple strand clasps 500.

In FIG. 10 and FIG. 11, series of jewel beads each have a through hole into which a thread is inserted to form a necklace, and the necklace can be opened or closed by connecting or disconnecting the clasps 400 or 500.

In a multi strand clasp 400 shown in FIG. 10, six piston members comprising three pairs of right and left piston members and a parts having corresponding six cylinder members make up the clasp 400. Here, strings 51, 52*m* and 53 may be the same or different depending upon the design as in the case of the conventional necklace shown in FIG. 11.

Also, the necklace having the clasp 400 according to the present invention can be used in any manner such as closing the strings 51 and 52 with each other. How to open and close the clasp 400 is the same as that described previously.

It should be noted that the present invention is not restricted to the foregoing embodiments and various modifications and alternations can be made without departing from the sprits and scopes of the present invention. For example, the lock pin 40 may be provided on the cylinder member 10, and the coil spring 12 may be provided on the piston member 20. Also, the W-shaped or M-shaped guide groove 30 may be provided on the outer circumference of the piston member, as illustrated in FIGS. 13 and 14.

What is claimed is:

1. A clasp comprising a piston member, a cylinder member, and a mechanism for attaching and detaching said piston member to said cylinder member, said mechanism comprising:

an elastic member which applies a resilient force to said piston member in the direction of detaching said piston member from said cylinder member;

a lock pin extending from one of said piston member and said cylinder member in substantially radial direction so that an elastic force is applied to said lock pin;

one of a W-shaped guide groove and an M-shaped guide groove including a concave portion for inserting said lock pin and having a route for directing the movement of the lock pin, said route comprising a first bent portion, a second bent portion, and a third bent portion located between an inlet and an outlet of said route; and a member for directing the movement of said lock pin.

2. The clasp according to claim 1, wherein said member for directing the movement of said lock pin is formed so that the line connecting a top of an inner circumference of said first bent portion to a top of an outer circumference thereof is slanted relative to the direction of separation of said piston member from said cylinder member, and the direction of the slanting is configured so that said top of said inner circumference of said first bent portion is nearer said inlet than said top of said outer circumference; and which further comprises a member for separating and locking said clasp comprising a concave portion formed in front of a projection of said second bent portion, a step-shaped inlet and a slope shaped outlet formed on said concave portion.

3. The clasp according to claim 1, further comprising an outer cover which supports the cylinder member in a rotatable manner.

4. The clasp according to claim 1, further comprising a guide taper formed near an insert hole of said cylinder or an edge of said piston member; said guide taper guides said lock pin toward said inlet of said guide groove.

5. The clasp according to claim 4, wherein said guide taper has one of a V-shape and a U-shape.

6. The clasp according to claim 1, wherein said lock pin is provided on the outer circumference of the piston member.

7. The clasp according to claim 1, wherein said lock pin is provided on said inner circumference of said cylinder member.

8. The clasp according to claim 1, wherein at least one of said piston member and said cylinder member has a decorative part detachably connected thereto.

9. The clasp according to claim 8, wherein said decorative part is transparent.

10. The clasp according to claim 1, wherein a plurality of said cylinder members or said piston members are unified to form a multi strand.

* * * * *